US009037054B2

(12) United States Patent
Mukai

(10) Patent No.: US 9,037,054 B2
(45) Date of Patent: May 19, 2015

(54) FIXING DEVICE AND IMAGE FORMING APPARATUS USING THE SAME

(75) Inventor: Takashi Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/479,536

(22) Filed: May 24, 2012

(65) Prior Publication Data

US 2013/0017003 A1 Jan. 17, 2013

(30) Foreign Application Priority Data

Jul. 14, 2011 (JP) ..... 2011-156047

(51) Int. Cl.
*G03G 15/20* (2006.01)

(52) U.S. Cl.
CPC ..... *G03G 15/2053* (2013.01); *G03G 15/2017* (2013.01); *G03G 2215/2003* (2013.01); *G03G 2215/2029* (2013.01); *G03G 2215/2032* (2013.01)

(58) Field of Classification Search
CPC ..... G03G 2215/2029; G03G 2215/2038; G03G 2215/2025; G03G 2215/2003; G03G 2215/2032; G03G 2215/2022; G03G 15/2053; G03G 15/2014; G03G 15/2017
USPC ..... 399/122, 328, 329
See application file for complete search history.

(56) References Cited

U.S. PATENT DOCUMENTS

| | | | | |
|---|---|---|---|---|
| 4,075,456 | A * | 2/1978 | Sakamaki et al. | 219/216 |
| 6,212,356 | B1 | 4/2001 | Ishikawa et al. | |
| 6,583,389 | B2 * | 6/2003 | Murooka et al. | 219/216 |
| 7,664,448 | B2 * | 2/2010 | Lee et al. | 399/329 |
| 7,769,333 | B2 * | 8/2010 | Shin et al. | 399/329 |
| 8,391,764 | B2 * | 3/2013 | Tanaka et al. | 399/329 |
| 8,712,300 | B2 * | 4/2014 | Mukai | 399/329 |
| 8,781,379 | B2 * | 7/2014 | Oishi et al. | 399/329 |
| 2005/0025538 | A1 * | 2/2005 | Omata | 399/329 |
| 2008/0304882 | A1 * | 12/2008 | Shin et al. | 399/329 |
| 2009/0324266 | A1 * | 12/2009 | Kobayashi | 399/45 |
| 2010/0329752 | A1 * | 12/2010 | Schulze-Hagenest et al. | 399/328 |
| 2011/0236089 | A1 * | 9/2011 | Tanaka et al. | 399/329 |
| 2011/0262193 | A1 * | 10/2011 | Kimura | 399/329 |
| 2012/0045261 | A1 * | 2/2012 | Mukai | 399/331 |
| 2013/0089350 | A1 * | 4/2013 | Mukai | 399/69 |

FOREIGN PATENT DOCUMENTS

| | | | |
|---|---|---|---|
| JP | 4-258982 | A | 9/1992 |
| JP | 5-289556 | | 11/1993 |
| JP | 2001-166618 | A | 6/2001 |
| JP | 2010-177142 | A | 8/2010 |
| JP | 2012-42746 | A | 3/2012 |
| WO | 99/00713 | | 1/1999 |

* cited by examiner

*Primary Examiner* — David Gray
*Assistant Examiner* — Carla Therrien
(74) *Attorney, Agent, or Firm* — Birch, Stewart, Kolasch & Birch, LLP

(57) ABSTRACT

A fixing device includes: a fixing belt that heats a recording medium with a toner image transferred thereon to fix the toner image to the recording medium; a heater unit for heating the fixing belt; and a tension roller that suspends the fixing belt in a rotatable manner. This fixing device is constructed such that the heater unit is extended in the direction of the belt width that is perpendicular to the rotational direction of the fixing belt and includes a planar heat generator that generates heat by supplying electricity, a heat transfer member arranged in contact with both the planar heat generator and the fixing belt and a reinforcing member for fixing the heat transfer member while the heat transfer member is joined to the reinforcing member.

2 Claims, 8 Drawing Sheets

FIXING DEVICE AND IMAGE FORMING APPARATUS USING THE SAME

This Nonprovisional application claims priority under 35 U.S.C. §119(a) on Patent Application No. 2011-156047 filed in Japan on 14 Jul. 2011, the entire contents of which are hereby incorporated by reference.

BACKGROUND OF THE INVENTION

1. Field of the Invention

The present invention relates to a fixing device and an image forming apparatus using the same, in particular, relating to a fixing device that fixes an unfixed toner image to a recording medium by heating the unfixed toner image formed on the recording medium as well as to an image forming apparatus using the same.

2. Description of the Prior Art

Conventionally, an electrophotographic image forming apparatus (which will be referred to simply as 'image forming apparatus' hereinbelow) includes: for example, a photoreceptor, a charging means, an exposure means, a developing means, a transfer means and a fixing means.

The image forming apparatus is a machine that performs a charging process, exposure process, developing process, transfer process and fixing process by use of the photoreceptor and these devices to form an image on a sheet-like recording medium (which will also be referred to simply as 'sheet' hereinbelow). As a fixing means for performing the fixing process, for example a heat roller type fixing device is used. The heat roller type fixing device includes a fixing roller and a pressing roller. The fixing roller and the pressing roller are a pair of rollers that are put in pressing contact with each other. At least one of the fixing roller and pressing roller incorporates a heat source such as a halogen heater or the like as a heating means.

In the fixing process, the roller pair is heated by the heat source to a predetermined temperature (which will be referred to hereinbelow as 'fixing temperature') necessary for fixing, then a recording medium with an unfixed toner image formed thereon is delivered to a fixing nip portion, or the pressing contact part, between the fixing roller and the pressing roller.

The unfixed toner image passing through the fixing nip portion is fixed to the recording medium such as paper or the like, with the heat transferred from at least one of the fixing roller and the pressing roller and under the pressure of the fixing roller and the pressing roller. The area, in the fixing nip portion, through which the recording medium has passed (which will be referred to hereinbelow as 'sheet passing area') lowers in temperature, but is heated to the fixing temperature by means of the heat source.

In a fixing device provided for an image forming apparatus capable of performing full-color printing, a fixing roller having an elastic layer made of silicone rubber or the like, formed on the surface thereof (which will be referred to hereinbelow as 'elastic roller') is used. Use of the elastic roller enables the elastic layer on the elastic roller surface to elastically deform in the fixing nip portion in conformity with the ruggedness of the unfixed toner image so that the elastic roller embraces, covers and comes into contact with, the unfixed toner image. Accordingly, this configuration exhibits more improved fixing performance for a color unfixed toner image which carries a greater amount of toner than a mono-color image.

Further, due to the strain releasing effect of the elastic layer on the elastic roller surface, it is possible to improve separation performance of the color toner which is more likely to offset compared to a mono-color image. More specifically, the elastic layer, which has been compressed and deformed in the fixing nip portion, is freed from its deformed condition at the exit of the fixing nip portion, so that a slippage arises between the elastic layer and the toner image at the exit of the fixing nip portion. As a result, the adherence of the elastic layer to the toner image lowers, hence the separation performance improves.

Further, since the nip configuration or the form of the fixing roller and the pressing roller in the fixing nip portion, is projected to the fixing roller side (forming an inverted nip configuration), it is possible to improve separation performance between the fixing roller and the recording medium. Accordingly, without use of any separation claws or the like as a separating means for separating the recording medium from the fixing roller, it is possible to realize a self-stripping mechanism that enables the recording medium to separate from the fixing roller and hence it is possible to dispel image defects attributed to separating means.

In order to make the fixing device deal with high-speed printing, it is necessary to make the width of the fixing nip portion (which will be referred to hereinbelow as 'fixing nip width') greater. As a means for making the fixing nip width greater, two methods can be considered; one way is to make the elastic layer of the elastic roller thicker, and the other is to increase the elastic roller in diameter.

However, since the elastic layer of the elastic roller is markedly low in thermal conductivity, when a heating device is provided inside the elastic roller as in the prior art elastic roller there occurs the problem that it takes long time for warming up if the elastic layer of the elastic roller is thick. Also, there occurs a problem that the temperature of the fixing roller cannot follow the fixing temperature when the processing speed is made higher.

Further, there occurs another problem that power consumption of the heating means increases as the elastic roller is made greater in diameter.

In order to solve these problems, as a prior art technology there has been a proposal of a fixing device based on a belt fixing mechanism including a fixing roller, a pressing roller, a heat roller and an endless belt, wherein an endless belt is wound between the fixing roller and the heat roller incorporating a heater for heating while the fixing roller and pressing roller are put in pressing contact with each other with the endless belt disposed therebetween (see patent document 1: International Publication WO99/00713).

According to the fixing device disclosed in patent document 1 (International Publication WO99/00713), it is possible to reduce the warm-up time because the endless belt having a small heat capacity is heated by the heat roller as a heating means without the necessity of heating the elastic layer having a greater heat capacity. Further, since it is possible to provide a thick elastic layer having a low hardness such as sponge rubber or the like without the necessity of heating means built in the fixing roller, it is possible to assure a large fixing nip width.

As another technology, there has been a proposal of a fixing device (see patent document 2: Japanese Patent Application Laid-open Hei5-No. 289556), in which a heating means given in the form of a planar heat generator is used to apply heat to the recording medium as a heated material through a film member so as to heat and fuse the unfixed toner image on the recording medium and thereby fix the image to the recording medium.

According to the fixing device disclosed in patent document 2 (Japanese Patent Application Laid-open Hei5-No. 289556), since the planar heat generator has a lower heat capacity than halogen lamp heaters, it is possible to suppress the heat capacity of the heating means compared to the prior art configuration with a halogen lamp heater. It is therefore possible to reduce power and shorten the warm-up time.

However, in the technology described in patent document 2, the heater portion takes a form in which a ceramic heater is directly bonded to a heat transfer plate. As a result, this configuration entails the problem that the ceramic heater is broken by the stress arising in the bonded area between the heater and the heat transfer plate due to frictional movement of the paper and the problem that heat transfer cannot be done satisfactorily due to change of the contact condition between the ceramic heater and the transfer plate.

SUMMARY OF THE INVENTION

The present invention has been devised in view of the above prior art problems, it is therefore an object of the present invention to provide a fixing device that can achieve uniform heating by keeping good heat transfer conditions and reducing power consumption and warm-up time and that can perform a stable fixing operation without causing any breakage and malfunction to the heating assembly, as well as to provide an image forming apparatus using this fixing device.

In order to achieve the above object, the fixing device according to the present invention and the image forming apparatus using this device are configured as follows:

According to the present invention, a fixing device includes: an endless belt that heats a recording medium (e.g., sheet material) with a toner image transferred thereon to fix the toner image to the recording medium; a heating assembly (e.g., heater unit) for heating the endless belt; and a suspending member (e.g., roller member) that suspends the endless belt in a rotatable manner, and is characterized in that the heating assembly is extended in the direction of the belt width that is perpendicular to the rotational direction of the endless belt, and includes a planar heat generator that generates heat by supplying electricity, a heat transfer member arranged in contact with both the planar heat generator and the endless belt and a reinforcing member for fixing the heat transfer member while the heat transfer member is joined to the reinforcing member.

According to the present invention, it is also preferred that the heat transfer member and the reinforcing member are joined at a plurality of points located along the width direction of the endless belt (in the longitudinal direction).

According to the present invention, it is also preferred that the planar heat generator includes a substrate (i.e., elongated in the width direction), extended in the width direction of the endless belt and a heat generation resistance layer made up of a plurality of strips extended on the substrate surface in the longitudinal direction of the substrate, and the length of the heat transfer member and the length of the heat generation resistance layer on the planar heat generator satisfy the following relation:

the length of the heat transfer member≥the length of the heat generation resistance layer on the planar heat generator.

Further, according to the present invention, an image forming apparatus that includes a fixing device comprising: an endless belt that heats a recording medium with a toner image transferred thereon to fix the toner image to the recording medium; a heating assembly for heating the endless belt in a rotatable manner; and a suspending member that suspends the endless belt and forms an image by fixing a toner image formed by electrophotography to a recording medium, is characterized in that the fixing device uses the above-described fixing device.

According to the fixing device of the present invention, the fixing device includes: an endless belt that heats a recording medium (e.g., sheet material) with a toner image transferred thereon to fix the toner image to the recording medium; a heating assembly (e.g., heater unit) for heating the endless belt; and a suspending member (e.g., roller member) that suspends the endless belt in a rotatable manner, and is characterized in that the heating assembly is extended in the direction of the belt width that is perpendicular to the rotational direction of the endless belt, and includes a planar heat generator that generates heat by supplying electricity, a heat transfer member arranged in contact with both the planar heat generator and the endless belt and a reinforcing member for fixing the heat transfer member while the heat transfer member is joined to the reinforcing member. Accordingly, this configuration makes it possible to provide a robust and stable fixing device that can heat the heat transfer member uniformly and is still free from occurrence of breakage and malfunction.

Specifically, in the fixing device, the planar heat generator is pressed against the rigid heat transfer member so as to enable the planer heat generator to give pressure in suitable position, whereby it is possible to realize a robust and stable configuration that can perform uniform heating.

According to the present invention, since the heat transfer member and the reinforcing member are joined at a plurality of points located along the width direction of the endless belt (in the longitudinal direction), this configuration can make uniform the heat leaking out to the reinforcing member side and can prevent deformation of the heat transfer member by the function of the force that presses the planar heat generator against the heat transfer member. Further, since the heat transfer member and the reinforcing member can be joined stably, it is possible to provide a robust and stable fixing device free from breakage and malfunction.

According to the present invention, the planar heat generator includes a substrate (i.e., elongated in the width direction), extended in the width direction of the endless belt and a heat generation resistance layer made up of a plurality of strips extended on the substrate surface in the longitudinal direction of the substrate, and the length of the heat transfer member and the length of the heat generation resistance layer on the planar heat generator satisfy the following relation: the length of the heat transfer member the length of the heat generation resistance layer on the planar heat generator. Accordingly, it is possible to make the length of the heat generation resistance layer on the planar heat generator approximately equal to that of the heat transfer member, hence prevent the heat transfer member from lowering in temperature at the ends thereof.

Further, since the heat generation resistance layer on the planar heat generator is formed to be approximately equal to or shorter than the heat transfer member, the entire part of the heat generation resistance comes into contact with the heat transfer member. As a result, it is possible to prevent an abnormal temperature rise of the planar heat generator.

Further, according to the image forming apparatus of the present invention, in the image forming apparatus includes a fixing device comprising: an endless belt that heats a recording medium with a toner image transferred thereon to fix the toner image to the recording medium; a heating assembly for heating the endless belt in a rotatable manner; and a suspending member that suspends the endless belt and forms an image by fixing a toner image formed by electrophotography to a recording medium, use of the fixing device defined any one of Claims 1 to 3 makes it possible to achieve uniform heating based on the heating assembly, and hence can provide a robust and stable image forming apparatus that is free from occurrence of breakage and malfunction in the heating assembly.

DESCRIPTION OF THE PREFERRED EMBODIMENTS

Now, modes for carrying out the present invention will be described with reference to the drawings.

Figure 1:
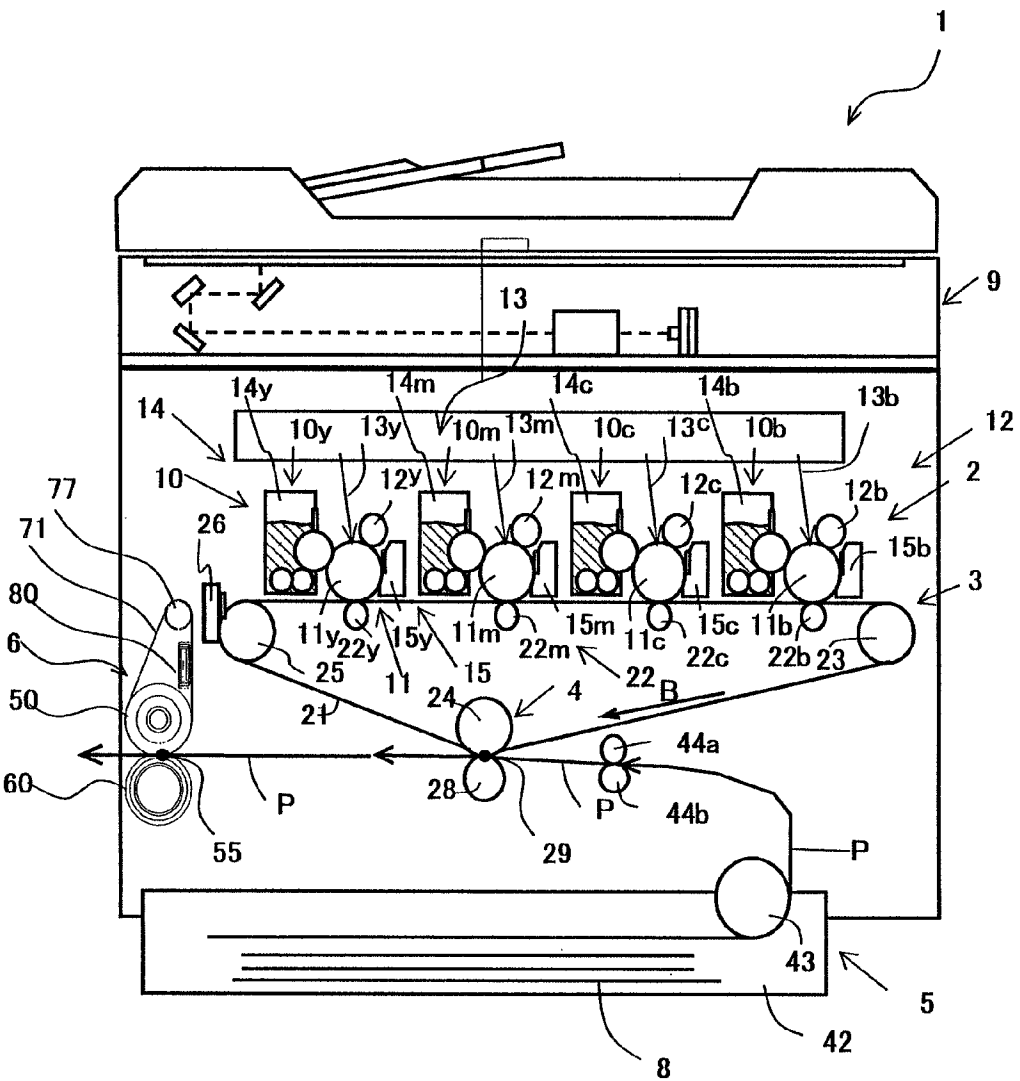
FIG. 1 is an illustrative diagram showing an overall configuration of an image forming apparatus according to the first embodiment of the present invention.
Figure 2:
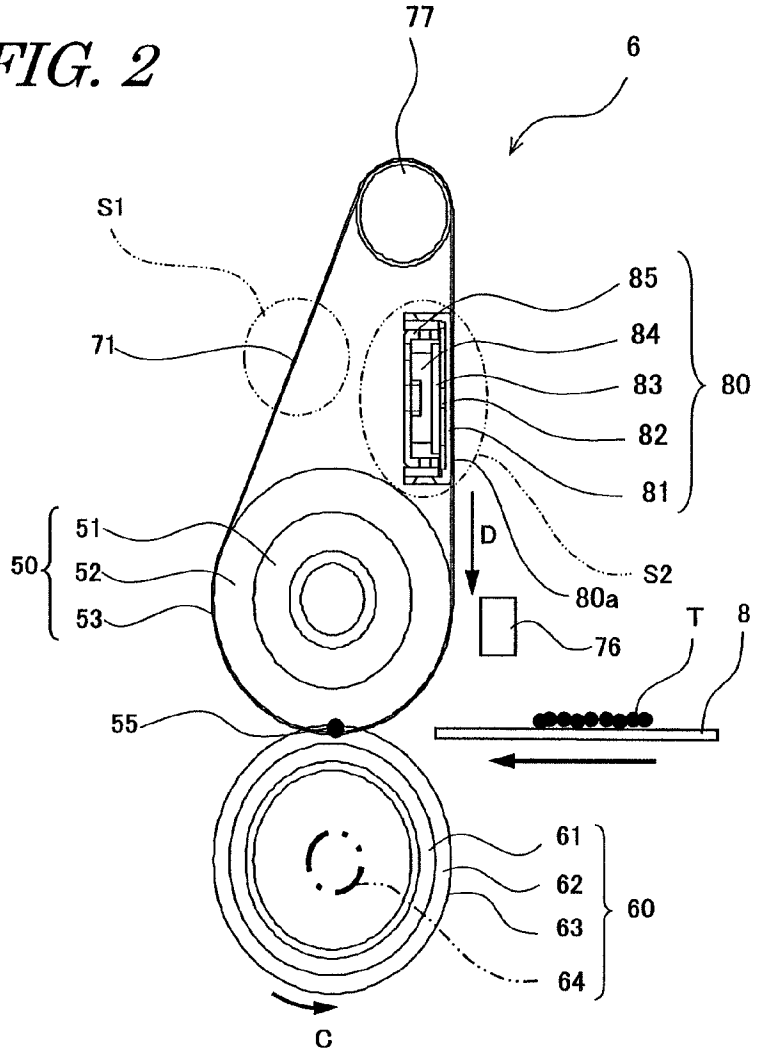
FIG. 2 is an illustrative diagram showing a characteristic configuration of a fixing device as a component of the image forming apparatus.
Figure 3:
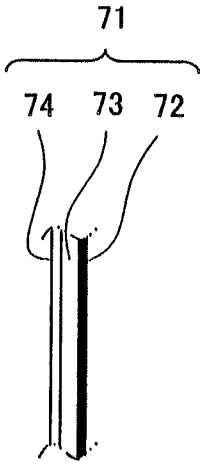
FIG. 3 is an illustrative diagram detailedly showing a fixing belt in an S1 portion in FIG. 2.
Figure 4B:
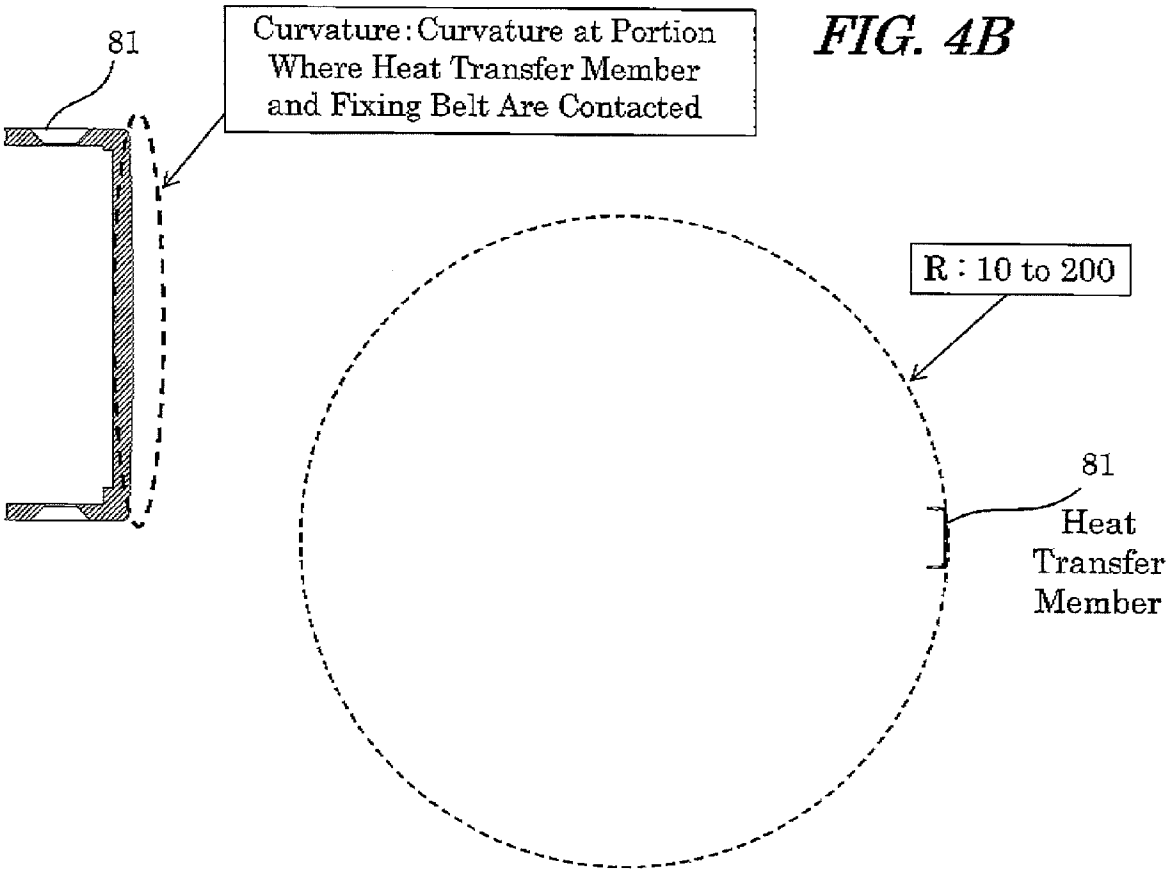
FIG. 4 is an illustrative diagram showing a heater unit in an S2 portion in FIG. 2.
Figure 4A:
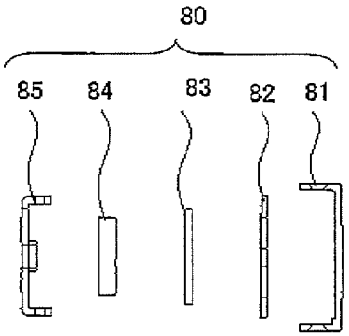

FIG. 1 is an illustrative diagram showing an overall configuration of an image forming apparatus according to the embodiment of the present invention. FIG. 2 is an illustrative diagram showing a characteristic configuration of a fixing device as a component of the image forming apparatus. FIG. 3 is an illustrative diagram detailedly showing a fixing belt in an S1 portion in FIG. 2. FIG. 4 is an illustrative diagram showing a heater unit in an S2 portion in FIG. 2.

The present embodiment provides a fixing device 6 as well as an image forming apparatus 1 as shown in FIG. 1, which includes fixing device 6 comprising: a fixing belt (endless belt) 71 that heats a recording medium (not shown) with a toner image transferred thereon to fix the toner image to the recording medium; a heater unit (heating assembly) 80 for heating fixing belt 71; a tension roller (suspending member) 77 that suspends fixing belt 71 in a rotatable manner; a fixing roller 50; and a pressing roller 60, and fixes toner images formed based on electrophotography to recording mediums, using the fixing device of the present invention.

To being with, the overall configuration of image forming apparatus 1 will be described.

Image forming apparatus 1 forms images on predetermined sheets (recording paper, recording mediums) in accordance with scanned image data of documents or image data externally transmitted. As shown in FIG. 1, image forming apparatus 1 includes: a scanner unit 9 as a document reader for reading image data of documents; an image forming portion 2 having image forming units 10 (10*y*, 10*m*, 10*c* and 10*b*) for forming toner images of four colors, i.e., black, cyan, magenta and yellow; an intermediate transfer unit 3 for temporarily carrying a toner image formed by image forming portion 2 on an intermediate transfer belt 21; a secondary transfer station 4 for transferring the toner image supported on intermediate transfer belt 21 to a recording medium; a recording medium feeder for feeding stored recording paper 8 to secondary transfer station 4; fixing device 6 for thermally fusing the toner image transferred on recording paper 8; and other components including a display portion, an operation control portion and a controller, not illustrated in FIG. 1.

Image forming units 10 (10*y*, 10*m*, 10*c* and 10*b*) include photoreceptor drums 11 (11*y*, 11*m*, 11*c* and 11*b*), charging rollers 12 (12*y*, 12*m*, 12*c* and 12*b*), light scanning units 13 (13*y*, 13*m*, 13*c* and 13*b*), developing units 14 (14*y*, 14*m*, 14*c* and 14*b*) and drum cleaners 15 (15*y*, 15*m*, 15*c* and 15*b*).

Intermediate transfer unit 3 includes, as shown in FIG. 1, intermediate transfer belt 21 that rotates in the direction of arrow B, intermediate transfer rollers 22 (22*y*, 22*m*, 22*c* and 22*b*) supporting rollers 23, 24 and 25 and a belt cleaner 26. In the present embodiment, the transfer means is essentially formed of intermediate transfer unit 3 and secondary transfer station 4.

In secondary transfer station 4, in synchronization with conveyance of the toner image on intermediate transfer belt 21 into the secondary transfer nip portion, recording paper 8 fed from recording medium feeder 5 is conveyed to secondary transfer nip portion 29. In secondary transfer nip portion 29, a multi-color toner image is laid over recording paper 8 while a high-voltage that has an opposite polarity to that of the static charge of the toner is uniformly applied to secondary transfer roller 28, whereby the unfixed toner image is secondarily transferred to recording paper 8. Then, the recording paper 8 carrying the unfixed toner image is conveyed to fixing device 6.

Recording medium feeder 5 includes, as shown in FIG. 1, a recording paper holding tray 42, a recording paper delivery roller 43, conveying rollers 44*a* and 44*b* and a conveying path P.

Recording paper holding tray 42 stores recording paper 8 as the recording medium. Recording paper delivery roller 43 sends out recording paper 8 from recording paper holding tray 42. Conveying rollers 44*a* and 44*b* convey the fed recording paper 8 to secondary transfer station 4.

Fixing device 6 is formed of a fixing roller 50, a pressing roller 60, a fixing belt (endless belt) 71, a tension roller (supporting member) 77 and a heater unit 80, as shown in FIG. 2.

Fixing roller 50 is a roller-shaped member that is rotatably supported by an unillustrated supporting means, and is rotationally driven in the direction of arrow D at a predetermined speed by rotational drive of pressing roller 60 and fixing belt 71. In the present embodiment, fixing roller 50 uses a cylindrically shaped roller member having a diameter of 30 mm, formed of a metal core 51 and an elastic layer 52.

The metal that forms metal core 51 may use a metal having a high thermal conductivity, examples including aluminum, iron and the like.

Fixing roller 50 may have a supplementary heating means therein. This is aimed at shortening the warm-up time from power activation of image forming apparatus 1 to standby for image forming, preventing the surface temperature of fixing roller 50 from being lowered due to heat transfer to recording paper 8 during fixing of toner images, and the like.

Pressing roller 60 is put in pressing contact with fixing roller 50 with fixing belt 71 therebetween by means of an unillustrated pressing mechanism, at a point downstream of the vertically lowest point of fixing roller 50 with respect to the rotational direction of fixing roller 50, to form a fixing nip portion 55. Pressing roller 60 is rotationally driven by means of an unillustrated drive means. Pressing roller 60 promotes fixing of the toner image to recording paper 8 by pressing recording paper 8 against the toner in a fused state when fixing roller 50 heats and fixes the toner image to recording paper 8. A reference numeral T in the drawing denotes unfixed toner.

In the present embodiment, pressing roller 60 uses a roller-shaped member having a diameter of 30 mm, formed of a metal core 61, an elastic layer 62 and a surface layer 63. Metal core 61, elastic layer 62 and surface layer 63 may use the same metal or material for forming metal core 51, elastic layer 52 and surface layer 53 of fixing roller 50. Further, metal core 61 has the same configuration as that of fixing roller 50.

Pressing roller 60 may have a heating means 64 therein. This is aimed at shortening the warm-up time from power activation of image forming apparatus 1 to standby for image forming, preventing the surface temperature of pressing roller 60 from being sharply lowered due to heat transfer to recording paper 8 during fixing of toner images, and the like. A halogen lamp or the like may be used for heating means 64.

Tension roller 77 is a roller-shaped member that is rotatably supported and arranged so as to apply tension to fixing belt 71 by means of an unillustrated pressing means. Tension roller 77 is rotationally driven in the rotational direction of arrow D of fixing belt 71. Tension roller 77 may use a metallic roller made of a metal having a high thermal conductivity, such as aluminum, iron or the like. The metallic roller may be formed on its surface with a fluoro-resin layer if required. Further, a heat-insulating material excellent in heat resistance such as silicone sponge or the like may be formed on the roller surface so that heat will not leak out to the metallic roller.

Fixing belt 71 is an endless belt member that is wound and tensioned between fixing roller 50 and tension roller 77, forming a circulative moving path.

Fixing belt 71 is arranged so as to come into contact with the pressing roller at the contact point between fixing roller 50 and pressing roller 60 and thereby heat and fuse the toner of the toner image supported on recording paper 8 and fix the toner image onto recording paper 8. Fixing belt 71 is rotationally driven in the direction of arrow D by rotational drive of pressing roller 60 in the direction of arrow C.

In the present embodiment, fixing belt 71 uses an endless belt given in a cylindrical form having a diameter of 50 mm and having a three-layered structure of an base layer 72, an elastic layer 73 and a separation layer 74, as shown in FIG. 3.

Next, the characteristic configuration of heater unit (heating assembly) 80 that constitutes fixing device 6 of the present embodiment will be described in detail with reference to the drawing.

Figure 5:
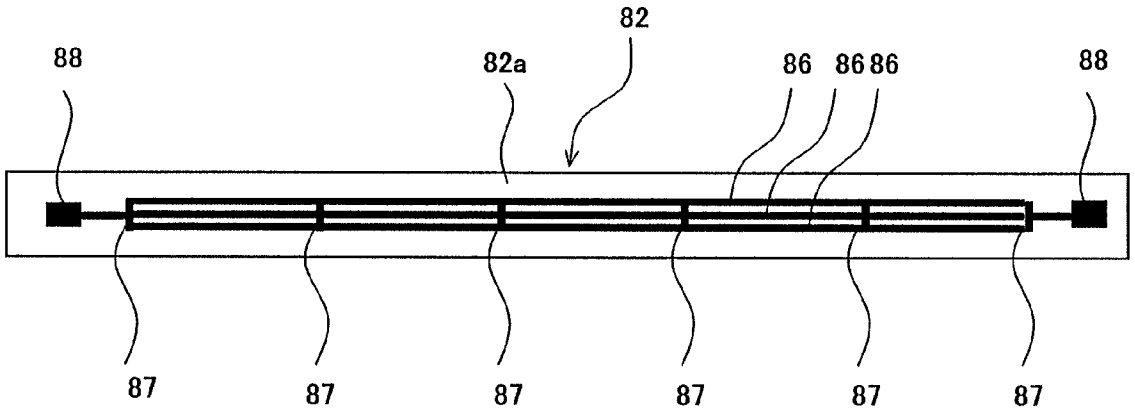
FIG. 5 is an illustrative diagram showing a configuration of a heat generator of a heater unit as a component of the fixing device.
Figures 6A, 6B, 6C, 6D:
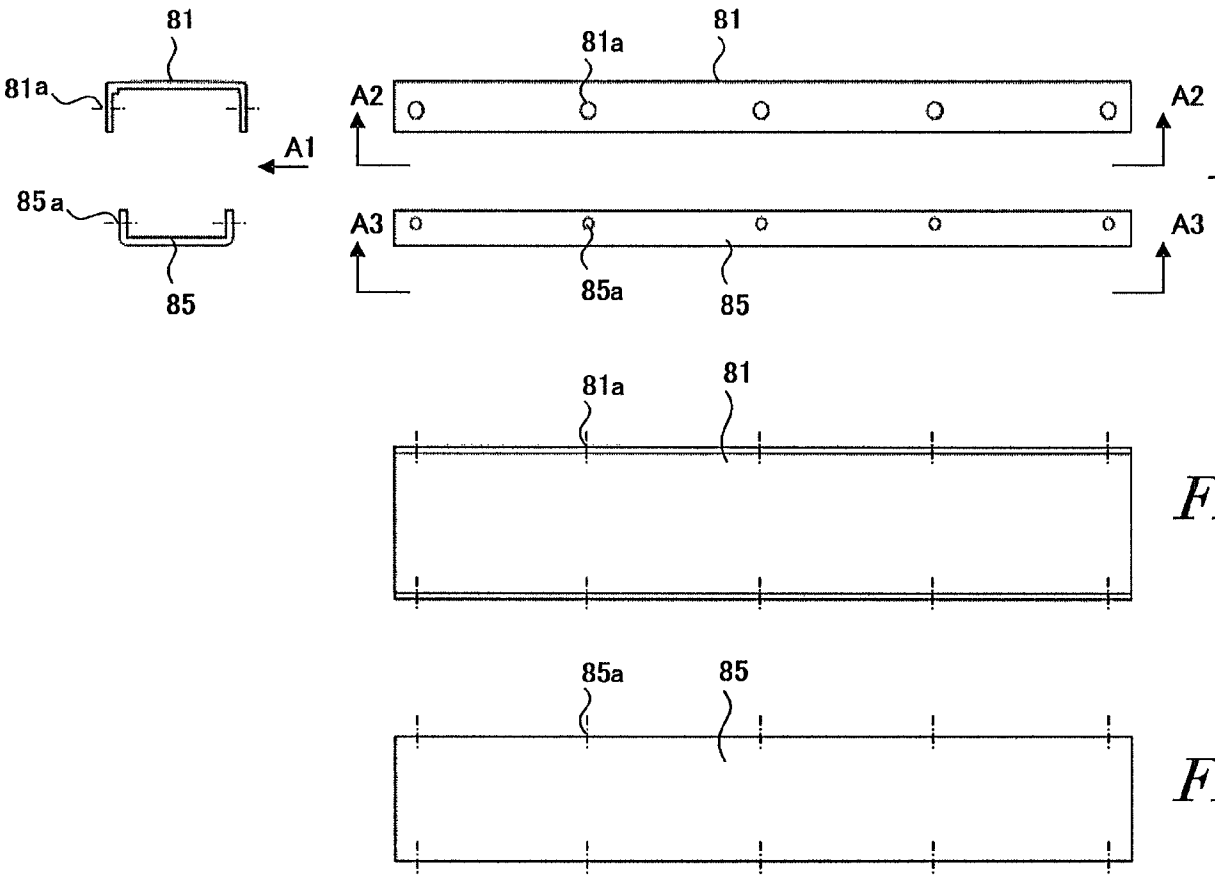
FIG. 6A is an illustrative diagram showing a configuration of a reinforcing member and a heat transfer member that form the heater unit.
FIG. 6B is a diagram viewed from the direction of an arrow A1 in FIG. 6A.
FIG. 6C is a diagram viewed from the direction of arrow A2-A2 in FIG. 6B
FIG. 6D is a diagram viewed from the direction of arrow A3-A3 in FIG. 6B.
Figures 7A, 7B, 7C, 7D:
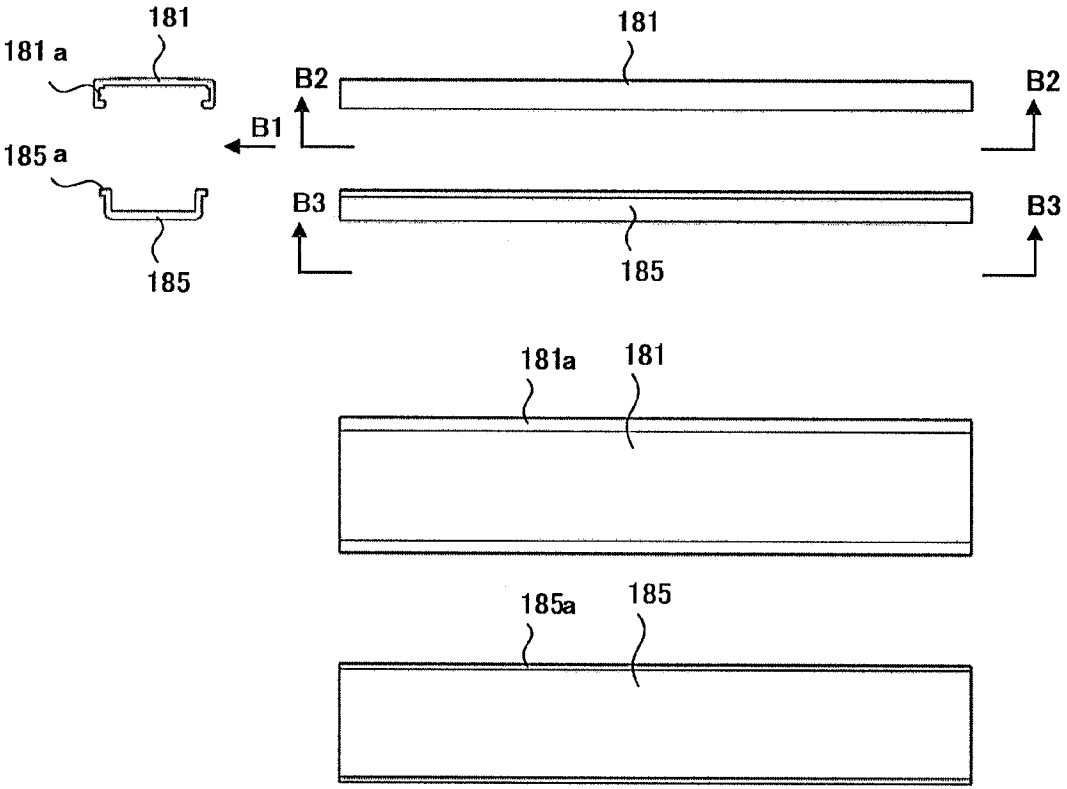
FIGS. 7A to 7D are illustrative diagrams showing a variational example 1 of the configuration of a reinforcing member and a heat transfer member that form the fixing device of the present exemplary embodiment, FIG. 7A an illustrative diagram showing a configuration of the reinforcing member and heat transfer member, FIG. 7B a diagram viewed from the direction of an arrow B1 in FIG. 7A, FIG. 7C a diagram viewed from the direction of arrow B2-B2 in FIG. 7B and FIG. 7D a diagram viewed from the direction of arrow B3-B3 in FIG. 7B; and, FIGS. 8A to 8D are illustrative diagrams showing a variational example 2 of the configuration of a reinforcing member and a heat transfer member that form the fixing device of the present exemplary embodiment, FIG. 8A an illustrative diagram showing a configuration of the reinforcing member and heat transfer member, FIG. 8B a diagram viewed from the direction of an arrow C1 in FIG. 8A, FIG. 8C a diagram viewed from the direction of arrow C2-C2 in FIG. 8B and FIG. 8D a diagram viewed from the direction of arrow C3-C3 in FIG. 8B.
Figures 8A, 8B, 8C, 8D:
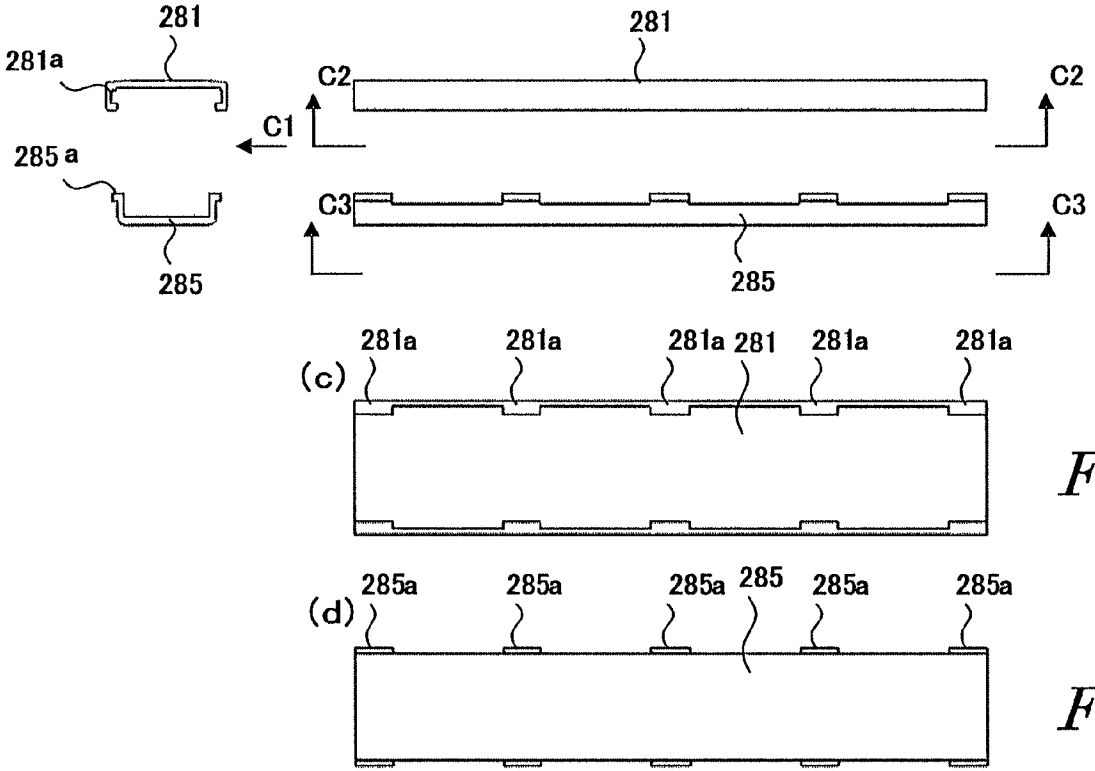

FIG. 5 is an illustrative diagram showing a configuration of a heat generator of a heater unit as a component of the fixing device of the present embodiment. FIG. 6A is an illustrative diagram showing a configuration of a reinforcing member and a heat transfer member of the heater unit, FIG. 6B is a diagram viewed from the direction of an arrow A1 in FIG. 6A, FIG. 6C is a diagram viewed from the direction of arrow A2-A2 in FIG. 6B and FIG. 6D is a diagram viewed from the direction of arrow A3-A3 in FIG. 6B.

As shown in FIGS. 2 and 4, heater unit 80 is an assembly that has a heat source therein and is extended in the direction of the belt width that is perpendicular to the rotational direction of fixing belt 71, and is pressed by an unillustrated pressing means against fixing belt 71 so as to heat fixing belt 71. Heater unit 80 is essentially made up of a heat transfer member 81, a planar heat generator 82, a heat insulating member 83, a pressing member 84 and a reinforcing member 85.

As shown in FIG. 5, planar heat generator 82 to be the heat source is made up of an elongated insulative substrate (which will be referred to hereinbelow as 'substrate') 82*a* of ceramics or the like, extended in the belt width direction of fixing belt 71, and having a rectangular strip-like shape when viewed from top, on which a plurality of heat generation resistors 86 of a silver-palladium alloy (AgPd) or the like are provided.

Substrate 82*a* is not particularly limited as long as it has heat resistance, good thermal conductivity, electric insulation and the like. Examples may include ceramic material such as aluminum oxide, aluminum nitride and the like. It is also possible to use a metal plate of SUS etc., coated with glass material excellent in heat resistance and having electric insulation. In the present embodiment, a SUS substrate of 366 mm long, 15.8 mm wide and 0.6 mm thick is used.

Heat generation resistors 86 are formed by forming a paste of conductive material on substrate 82*a* in a predetermined pattern by printing or any other method. In the present embodiment, three linear resistance patterns are formed.

As shown in FIG. 5, each heat generation resistor 86 is formed with conductive contacts 87 between terminal elements at both ends, in order to stabilize the resistance in the longitudinal direction. Heat generation register 86 may use silver-palladium paste or the like. Conductive contact 87 may use silver paste or the like. Here, heat generation resistor 86 and conductive contact 87 are each formed of a layer of about 10 μm thick. One and the other ends of heat generation resistors 86 are commonly connected to terminal electrodes 88 at both ends.

The planar heat generator 82 is loaded into a heat-treatment furnace, where the ceramic sheet is heat treated under a predetermined heat-treatment condition, then the heat generation resistor surface is coated with an insulating material such as glass material, forming an insulative protecting layer, to complete the planar heat generator.

In the present embodiment, the length of heat generation resistors 86 is specified to be 320 mm.

Heat transfer member 81 is a member that transfers heat from planar heat generator 82 to fixing belt 71.

Though the material of heat transfer member 81 is not particularly limited as long as it has heat resistance and good thermal conductivity, metals such as aluminum, iron and the like are preferred.

In order to stabilize connection between heat transfer member 81 and reinforcing member 85, heat transfer member 81 is preferably given in a form having a rectangled U-shaped section, as shown in FIG. 4.

Further, as shown in FIGS. 6A to 6D, heat transfer member 81 and reinforcing member 85 are formed with a plurality of attachment holes 81*a* and screw holes 85*a*, respectively, along the longitudinal direction so that heat transfer member 81 and reinforcing member 85 can be fixed to each other by means of screws (not shown) to thereby establish stable connection.

Further, since heat transfer member 81 and reinforcing member 85 are joined at multiple points along the longitudinal direction, it is possible to prevent heat transfer member 81 from being locally lowered in temperature. It is also possible to prevent occurrence of unequal pressing due to deformation of heat transfer member 81 as a result of flexure of heat transfer member 81.

In the present invention, heat transfer member 81 is made of aluminum and formed to be 320 mm long.

That is, heat transfer member 81 is formed to have the same length as that of heat generator resistors 86 of planar heat generator 82. With this configuration, it is possible to efficiently transfer heat from heat generation resistors 86.

Here, the length of heat transfer member 81 may be specified to be greater than that of heat generation resistors 86.

Since the surface of heat transfer member 81 is rubbed by the interior surface of fixing belt 71, the side of heat transfer member opposing fixing belt 71 is preferably formed to have a semi-cylindrically projected configuration having a curvature. However, if the curvature is large, fixing belt 71 cannot follow the shape of heat transfer member 81, so that there occurs trouble that fixing belt 71 floats from heat transfer member 81 in the middle of heat transfer member 81. Accordingly, it is preferably that the radius of curvature R of heat transfer member 81 is set within a range of 10 to 200 (mm).

Further, in order to enable fixing belt 71 to smoothly move over heat transfer member 81, the surface of heat transfer member 81 may be formed with a fluoro-resin layer, as necessary.

Heat insulating member 83 is formed long along planar heat generator 82. This heat insulating member 83 is arranged between planar heat generator 82 and pressing member 84 in order to prevent heat from diffusing through pressing member 84 from planar heat generator 82, and is not particularly limited as long as it is excellent in heat resistance and heat insulation. The heat insulating member may use a foamed polyimide sheet, an aramid sheet and the like.

Reinforcing member 85 is arranged along heat transfer member 81 so as to have approximately the same length therewith, and is given in a form having a rectangled U-shaped section in order to stabilize connection with heat transfer member 81, as shown in FIGS. 6A to 6D.

Reinforcing member 85 is provided to prevent heater unit 80 from being deformed when heater unit 80 is put into contact with the fixing belt. It also functions as a member for establishing stable connection between heat transfer member 81 and reinforcing member 85. Though reinforcing member 85 is not particularly limited as long it has heat resistance and is high in rigidity, it is preferably formed of metal such as iron or the like.

Next, temperature control in fixing device 6 of the present embodiment will be described.

As shown in FIG. 2, the temperature of fixing device 6 is detected by a thermistor 76. Thermistor 76 is laid out at a position close to the fixing roller 50 side, on the upstream side with respect to the direction in which recording paper 8 is conveyed between fixing roller 50 and pressing roller 60.

Detailedly, thermistor 76 is arranged close to fixing belt 71, at a position downstream of a contact point 80*a* between heater unit 80 and fixing belt 71 with respect to the circulating direction of the belt and upstream of the contact point between fixing belt 71 and pressing roller 60, to detect the temperature of fixing belt 71. The detected result from thermistor 76 is input to the CPU.

The CPU determines whether the temperature of thermistor 76 falls within a set range, based on the detected result from thermistor 76. If the temperature of fixing belt 71 is lower than the set range, the CPU transmits a control signal to an after mentioned power source connected to planar heat generator 82 of heater unit 80 to supply power to planar heat generator 82 and promote heat generation. If the temperature of fixing belt is higher than the set range, the CPU checks whether power is being supplied to planar heat generator 82. If power supply is being continued, a control signal to stop power supply is transmitted.

In this way, the fixing mechanism of fixing device 6 including fixing roller 50, heater unit 80, fixing belt 71 and pressing roller 60 is controlled by the unillustrated CPU (Central Processing Unit) for controlling the whole operation of image forming apparatus 1.

This CPU corresponds to the above-described controller.

As receiving input of an image forming command, the CPU transmits a control signal to the unillustrated power source for supplying power to planar heat generator 82 provided for heater unit 80 and heating means 64 provided inside pressing roller 60. The image forming command is input through an unillustrated control panel arranged on the vertical top of image forming apparatus 1 or input from an external device such as a computer or the like that is connected to image forming apparatus 1.

The power source having received the control signal supplies power to activate planar heat generator 82 and heating means 64.

Planar heat generator 82 and heating means 64 heat heater unit 80, fixing roller 50, pressing roller 60 and the fixing belt 71 surface up to respective set temperatures.

When unillustrated temperature detecting sensors arranged close to fixing roller 50 and pressing roller 60, detect arrival to the set temperatures and the detected result is input to the CPU, the CPU sends a control signal to an unillustrated drive means for rotationally driving fixing roller 50 so as to rotate and drive pressing roller 60 in the direction of arrow C.

Thereby, fixing belt 71, fixing roller 50 and pressing roller 60 rotate. In this state, recording paper 8 carrying an unfixed toner image thereon is conveyed from secondary transfer roller 28 (see FIG. 1) to fixing nip portion 55 of fixing device 6. As this recording paper 8 passes through fixing nip portion 55, the toner forming the toner image is heated and pressed so as to form a fixed image on recording paper 8.

According to the present embodiment thus configured, in fixing device 6, heater unit 80 is extended in the width direction of the belt that is perpendicular to the circulating direction of fixing belt 71, and includes planar heat generator 82 that generates heat by supplying electricity, heat transfer member 81 arranged in contact with both planar heat generator 82 and fixing belt 71 and reinforcing member 85 for fixing heat transfer member 81 while heat transfer member 81 is jointed to reinforcing member 85. Accordingly, it is possible to provide robust and stable fixing device 6 that can heat transfer member 81 uniformly without flexing or deforming the heat transfer member and is still free from occurrence of breakage and malfunction of heater unit 80.

Also, in the present embodiment, since heat transfer member 81 and reinforcing member 85 are joined at multiple points along the longitudinal direction while the length of heat transfer member 81 and that of heat generation resistors 86 on the planar heat generator 82 are made approximately equal to each other, it is possible to prevent heat transfer member 81 from lowering in temperature at the ends thereof.

Further, according to the present embodiment, since it is possible to establish stable joining between heat transfer member 81 and reinforcing member 85, it is possible to prevent occurrence of trouble such as contact failure between planar heat generator 82 and heat transfer member 81 and damage to planar heat generator 82 due to frictional movement of fixing belt 71.

Though, in the present embodiment, heat transfer member 81 and reinforcing member 85 are given in the forms having rectangled U-shaped sections and joined with their opening sides opposing each other by fixing screws from both sides, at multiple points along the longitudinal direction, the present invention should not be limited to this arrangement of heat transfer member 81 and reinforcing member 85.

For example, as a variational example 1 shown in FIGS. 7A to 7D, a heat transfer member 181 and a reinforcing member 185 may be formed so as to have approximately rectangled U-shaped sections and so that an engagement 181*a* depressed to the interior is formed in the longitudinal direction on either longitudinal side of heat transfer member 181 while an outward projected engagement 185*a* is formed in the longitudinal direction on either longitudinal side of reinforcing member 185 so that the projected engagement will engage corresponding engagement 181*a* of heat transfer member 181.

With this arrangement, it is possible to join heat transfer member 181 to reinforcing member 185 without using any screw-fitting as used in the above-described embodiment of heat transfer member 81 and reinforcing member 85.

As another variational example 2 shown in FIGS. 8A to 8D, a heat transfer member 281 and a reinforcing member 285 may be formed so as to have approximately rectangled U-shaped sections and so that a plurality of engagements 281*a* depressed to the interior are formed in the longitudinal direction on either longitudinal side of heat transfer member 281 while a plurality of outward projected engagements 285*a* are formed in the longitudinal direction on either longitudinal side of reinforcing member 285 so that the projected engagements will engage corresponding engagements 281*a* of heat transfer member 281.

With this arrangement, it is possible to attach reinforcing member 285 to heat transfer member 281 by inserting projections of engagements 285*a* into corresponding depressed portions of engagements 281*a*. Accordingly, it is possible to join heat transfer member 281 to reinforcing member 285 in a more simplified manner.

Having described heretofore, the present invention is not limited to the above embodiments, various changes can be made within the scope of the appended claims. That is, any embodied mode obtained by combination of technical means modified as appropriate without departing from the spirit and scope of the present invention should be included in the technical art of the present invention.

What is claimed is:

1. A fixing device comprising:

an endless belt that heats a recording medium with a toner image transferred thereon to fix the toner image to the recording medium;

a heating assembly for heating the endless belt; and a suspending member that suspends the endless belt in a rotatable manner, characterized in that the heating assembly is extended in a direction of a belt width that is perpendicular to a rotational direction of the endless belt, and includes a planar heat generator that generates heat through resistive heating, a heat transfer member arranged in contact with both the planar heat generator and the endless belt and a reinforcing member for fixing the heat transfer member while the heat transfer member is joined to the reinforcing member, wherein the heat transfer member is formed in a shape having a rectangled U-shaped section which is larger in size than the reinforcing member such that the reinforcing member fits within the rectangled U-shaped section, wherein the reinforcing member is formed in a shape having a rectangled U-shaped section that fits within the rectangled U-shaped section of the heat transfer member, wherein the rectangled U-shaped section of the heat transfer member has an engagement depressed toward the interior of the rectangled U-shaped section of the heat transfer member that is formed in a longitudinal direction on either longitudinal side of the heat transfer member, and the rectangled U-shaped section of the reinforcing member has an outward projected engagement that is formed in the longitudinal direction on either longitudinal side of the reinforcing member such that the projected engagement will engage said corresponding engagement of the heat transfer member.

2. A fixing device comprising:

an endless belt that heats a recording medium with a toner image transferred thereon to fix the toner image to the recording medium;

a heating assembly for heating the endless belt; and a suspending member that suspends the endless belt in a rotatable manner, characterized in that the heating assembly is extended in a direction of a belt width that is perpendicular to a rotational direction of the endless belt, and includes a planar heat generator that generates heat through resistive heating, a heat transfer member arranged in contact with both the planar heat generator and the endless belt and a reinforcing member for fixing the heat transfer member while the heat transfer member is joined to the reinforcing member, wherein the heat transfer member is formed in a shape having a rectangled U-shaped section which is larger in size than the reinforcing member such that the reinforcing member fits within the rectangled U-shaped section, wherein the reinforcing member is formed in a shape having a rectangled U-shaped section that fits within the rectangled U-shaped section of the heat transfer member, wherein the rectangled U-shaped section of the heat transfer member has a plurality of engagements depressed toward the interior of the rectangled U-shaped section of the heat transfer member that are formed in a longitudinal direction on either longitudinal side of the heat transfer member, and the rectangled U-shaped section of the reinforcing member has a plurality of outward projected engagements that are formed in the longitudinal direction on either longitudinal side of the reinforcing member such that the projected engagements will engage corresponding said engagements of the heat transfer member.

* * * * *